US007796911B2

(12) United States Patent
Kato et al.

(10) Patent No.: US 7,796,911 B2
(45) Date of Patent: Sep. 14, 2010

(54) IMAGE FORMING DEVICE HAVING A BELT CLEANING UNIT

(75) Inventors: Atsushi Kato, Ichinomiya (JP); Hiroshi Nakano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1012 days.

(21) Appl. No.: 11/455,789

(22) Filed: Jun. 20, 2006

(65) Prior Publication Data

US 2006/0285871 A1 Dec. 21, 2006

(30) Foreign Application Priority Data

Jun. 20, 2005 (JP) ..... 2005-179590
Jul. 21, 2005 (JP) ..... 2005-211347

(51) Int. Cl.
*G03G 21/00* (2006.01)

(52) U.S. Cl. ..... 399/99; 399/101; 399/102; 399/103; 399/351; 399/353; 399/357

(58) Field of Classification Search ..... 399/99, 399/101–103, 351, 353, 357
See application file for complete search history.

(56) References Cited

U.S. PATENT DOCUMENTS 4,278,342 A * 7/1981 Andrew et al. ..... 399/169
5,374,980 A * 12/1994 Kubo et al. ..... 399/233
5,999,784 A * 12/1999 Tsukida et al. ..... 399/297
6,374,073 B2 * 4/2002 Ozaki et al. ..... 399/298
6,480,695 B2 * 11/2002 Endo et al. ..... 399/349
6,640,073 B2 * 10/2003 Kurotori et al. ..... 399/237
6,674,987 B2 * 1/2004 Nishimura et al. ..... 399/297
6,819,350 B2 * 11/2004 Yokoi ..... 347/228
6,829,460 B2 * 12/2004 Kurotori et al. ..... 399/237
7,003,248 B2 * 2/2006 Kurotori et al. ..... 399/249
7,177,576 B2 * 2/2007 Kamijo et al. ..... 399/237
7,447,454 B2 * 11/2008 Nishimura et al. ..... 399/66
7,471,921 B2 * 12/2008 Fuwazaki et al. ..... 399/284
2001/0053298 A1 * 12/2001 Fujishiro et al. ..... 399/159
2004/0213598 A1 * 10/2004 Mori et al. ..... 399/101
2005/0100357 A1 * 5/2005 Nishimura et al. ..... 399/66

(Continued)

FOREIGN PATENT DOCUMENTS

JP 05197317 A * 8/1993

(Continued)

*Primary Examiner*—David M Gray
*Assistant Examiner*—Geoffrey T Evans
(74) *Attorney, Agent, or Firm*—Banner & Witcoff, Ltd

(57) ABSTRACT

An image-forming device has a developer-carrying member, an image-carrying member, a belt, and a cleaning unit. The developer-carrying member has an outer surface including a layer forming region for carrying a thin layer of developer. The layer forming region has a first width in a widthwise direction. The layer forming region includes an effective image forming region used for forming an image on a recording medium. The belt is configured to circulate in a moving direction orthogonal to the widthwise direction and transfer the developer image onto the recording medium. The cleaning unit cleans the developer on a cleanable region, which has a second width which is greater than the first width. The cleanable region is placed with respect to the thin layer forming region so that each widthwise end of the second width is positioned outside of each widthwise end of the first width in the widthwise direction.

15 Claims, 12 Drawing Sheets

U.S. PATENT DOCUMENTS

| | | | | |
|---|---|---|---|---|
| 2006/0083538 | A1* | 4/2006 | Terae et al. | 399/101 |
| 2006/0239724 | A1* | 10/2006 | Fuwazaki et al. | 399/284 |
| 2009/0185843 | A1* | 7/2009 | Chiba et al. | 399/348 |

FOREIGN PATENT DOCUMENTS

| | | | |
|---|---|---|---|
| JP | 8-030121 | | 2/1996 |
| JP | 08030121 | A * | 2/1996 |
| JP | 8073066 | | 3/1996 |
| JP | 8-106218 | | 4/1996 |
| JP | 9-152788 | | 6/1997 |
| JP | 11-052664 | | 2/1999 |
| JP | 11-52665 | | 2/1999 |
| JP | 2003-149953 | | 5/2003 |
| JP | 2003-162193 | | 6/2003 |
| JP | 2005114755 | A * | 4/2005 |
| JP | 2005250047 | A * | 9/2005 |

* cited by examiner

IMAGE FORMING DEVICE HAVING A BELT CLEANING UNIT

BACKGROUND OF THE INVENTION

1. Technical Field

The present invention relates to an image-forming device including a cleaning unit for cleaning a belt.

2. Related Art

Japanese Patent No. 3,403,816 discloses an image-forming device including an image-carrying member on which a developer image is formed; an endless belt to which the developer image carried on the image-carrying member is transferred; and a cleaning unit for cleaning the endless belt. The cleaning unit cleans a portion of the belt which has a width equal to or slightly greater than a width of an effective image forming region on the image-carrying member. Here, the effective image forming region is provided on the image-carrying member on which an electrostatic latent image is formed, developed into a developer image, and transferred to the recording medium with a uniform quality, for forming an image on a recording medium. The effective image forming region is generally defined on the surface of the image-carrying member slightly inside both ends thereof in a widthwise direction.

In the image-forming device having this construction, the cleaning unit generally cleans developer on a region of the endless belt corresponding to the effective image forming region.

Generally, the above type of image-forming device has a developer-carrying member for supplying developer to the image-carrying member. The developer-carrying member normally carries a thin layer of developer on a thin film forming region on the outer surface thereof. The thin layer has a with width which is greater than that of the effective image forming region.

The developer sometimes reaches the endless belt from the thin layer forming region. Therefore, a problem arises in that the conventional cleaning unit is not sufficient to clean the deposited developer on the endless belt.

SUMMARY

In view of the foregoing, it is an object of the present invention to provide an image-forming device capable of readily cleaning the outer surface of the belt.

The present invention provides an image-forming device having a developer-carrying member, an image-carrying member, a belt, and a cleaning unit. The developer-carrying member has an outer surface including a thin layer forming region for carrying a thin layer of developer. The thin layer forming region has a first width in a widthwise direction. The thin layer forming region includes an effective image forming region used for forming an image on a recording medium. The effective image forming region has a width which is shorter than the first width. The image-carrying member has a surface on which an electrostatic latent image based on the image is formed and developed into a developer image by the developer carried on the effective image forming region. The belt is configured to circulate in a moving direction orthogonal to the widthwise direction and transfer the developer image onto the recording medium. The belt has an outer surface including a cleanable region having a second width in the widthwise direction. The cleaning unit cleans the developer on the cleanable region. The second width is greater than the first width. The cleanable region is placed with respect to the thin layer forming region so that each widthwise end of the second width is positioned outside of each widthwise end of the first width in the widthwise direction.

The present invention provides an image-forming device having an image-carrying member, a belt, and a cleaning unit. The image-carrying member carries a developer image made from developer. The belt has an outer surface and a first width in a widthwise direction. The belt is configured to circulate in a direction orthogonal to the widthwise direction and transfer the developer image onto a recording medium. The cleaning unit cleans the developer on the outer surface. The cleaning unit has a rotating member made from a foam material. The rotating member contacts the outer surface. The rotating member has a second width in the widthwise direction. The second width is shorter than the first width. The rotating member is placed with respect to the belt so that each widthwise end of the second width is positioned inside of a corresponding widthwise end of the first width in the widthwise direction.

BRIEF DESCRIPTION OF THE DRAWINGS

The aforementioned aspects and other features of the invention are explained in the following description, taken in connection with the accompanying drawing figures wherein.

DESCRIPTION OF THE EMBODIMENTS

Embodiments of the present invention will be described with reference to FIGS. 1 through 5. In the following description, the expressions "front", "rear", "above" and "below" are used throughout the description to define the various parts when an image forming device is disposed in an orientation in which it is intended to be used.

Figure 1:
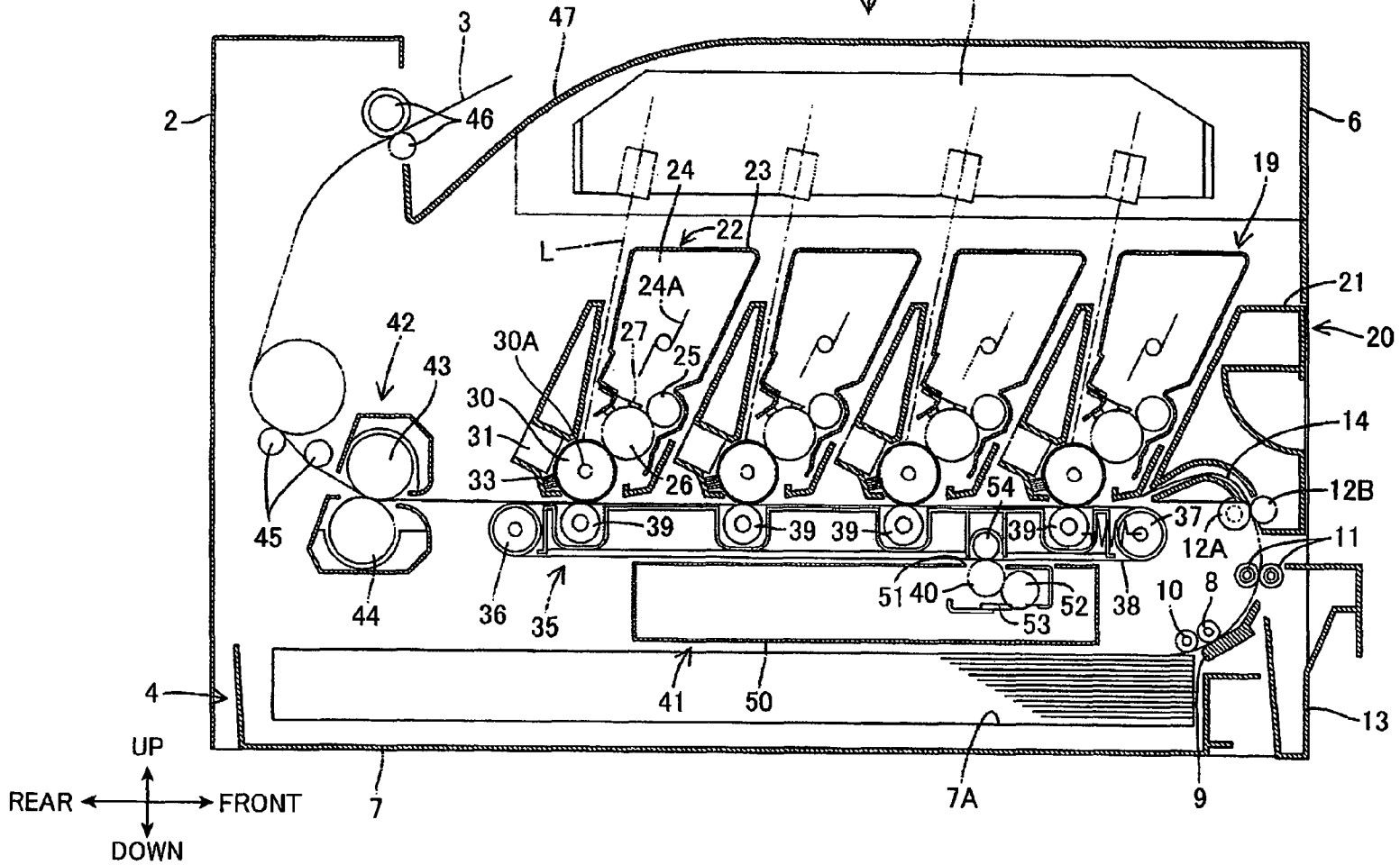
FIG. 1 is a side cross-sectional view of a direct tandem type color laser printer according to the present invention.

General structure of an image forming device will be explained as follows. FIG. 1 shows a laser printer 1 according to a first embodiment of the present invention. The laser printer 1 is a direct tandem type color laser printer having four photosensitive drums 30 corresponding to the colors: black, cyan, magenta, and yellow. The laser printer 1 includes a main casing 2 and, within the main casing 2, a paper supply unit 4 for supplying a paper 3, a scanning unit 18 for exposing the photosensitive drums 30, an image-forming unit 20 for forming images on the paper 3 supplied from the paper supply unit 4, and a paper-conveying unit 35 for conveying the paper 3 to the image-forming unit 20. In the following description, the left and right sides in FIG. 1 will be referred to as the front and the rear, respectively.

The paper supply unit with be explained as follows. The paper supply unit 4 includes a paper tray 7 detachably mounted in a lower section of the main casing 2; a feeding roller 8 and a separating pad 9 disposed above a front end of the paper tray 7; a pickup roller 10 disposed on the rear side of the feeding roller 8; a pair of paper dust rollers 11 disposed above and forward of the feeding roller 8; and a pair of registration rollers 12A and 12B disposed above the paper dust rollers 11.

The paper tray 7 has a thin plate shape and is formed to accommodate sheets of the paper 3 stacked therein. The paper tray 7 has a front wall 13 provided on the front end thereof. The front wall 13 is positioned below a front cover 6 provided on the front surface of the main casing 2. The paper tray 7 can be pulled horizontally through the front of the main casing 2 by pulling forward on the front wall 13. A paper-pressing plate 7A is provided on the bottom surface of the paper tray 7 for supporting the paper 3 in a stacked formation. The paper-pressing plate 7A is pivotably supported on the bottom surface of the paper tray 7 at the rear end thereof. A spring (not shown) is disposed beneath the front end of the paper-pressing plate 7A for urging the paper-pressing plate 7A upward so that a front edge of the paper 3 stacked in the paper tray 7 is urged upward.

Through the urging force of the paper-pressing plate 7A, the topmost sheet of paper 3 stacked in the paper tray 7 is pressed against the pickup roller 10. By rotating, the pickup roller 10 begins conveying the paper 3 until the leading edge of the paper 3 becomes interposed between the feeding roller 8 and separating pad 9. As the feeding roller 8 rotates, the paper 3 becomes interposed between the feeding roller 8 and separating pad 9 and is separated and conveyed one sheet at a time. Each sheet of paper 3 is conveyed by the feeding roller 8 toward the registration rollers 12A and 12B while the paper dust rollers 11 remove paper dust from the paper 3.

The registration rollers 12A and 12B are configured of a drive roller 12A and a follow roller 12B. After correcting the registration of the paper 3, the registration rollers 12A and 12B convey the paper 3 along a paper-conveying path 14 formed in a U-shape to flip the sheet of paper 3 over and convey the sheet in a front-to-rear direction onto a transfer belt 38 of the paper-conveying unit 35 described later.

The scanning unit 18 will be explained as follows. The scanning unit 18 is disposed in an upper section of the main casing 2. The scanning unit 18 irradiates laser beams L for each color onto the surfaces of the corresponding photosensitive drums 30 (described later) in a high-speed scan based on prescribed image data. The four laser beams L corresponding to the four colors are irradiated obliquely downward and rearward from the bottom surface of the scanning unit 18, and follow optical paths formed parallel to each other and spaced at regular intervals in the front-to-rear direction.

The image-forming unit 20 will be explained as follows. An accommodating section 19 is provided inside the main casing 2 below the scanning unit 18 for detachably accommodating the image-forming unit 20. The image-forming unit 20 can be removed from the accommodating section 19 in a forward direction. The image-forming unit 20 includes a frame 21 for supporting four each of the photosensitive drums 30, Scorotron chargers 31, developer cartridges 22, and cleaning brushes 33 corresponding to the four colors black, cyan, magenta, and yellow. Since the structure of these components is identical for each color, reference numerals have only been given for components of the color on the left in FIG. 1.

The developer cartridges 22 are detachably mounted in the frame 21 and correspond to the colors black, cyan, magenta, and yellow, respectively. Each developer cartridge 22 is configured of an accommodating case 23 having a box shape with an open bottom side. A toner-accommodating chamber 24 is formed in the top portion of the accommodating case 23 and is filled with a positively charged, nonmagnetic, single-component toner T for each color. An agitator 24A is provided inside the toner-accommodating chamber 24. The agitator 24A is driven to rotate by a driving force transmitted from a motor (not shown) so as to agitate the toner T in the toner-accommodating chamber 24. Below the toner-accommodating chamber 24, the accommodating case 23 also accommodates a supply roller 25, a developing roller 26, and a thickness-regulating blade 27.

The supply roller 25 is rotatably supported in the accommodating case 23 of the developer cartridge 22 and includes a metal roller shaft covered by a roller formed of an electrically conductive foam material. The supply roller 25 is driven to rotate by a driving force transmitted from the motor (not shown).

The developing roller 26 is rotatably supported in the accommodating case 23 diagonally below and rearward of the supply roller 25 and contacts the supply roller 25 with pressure so that both are compressed The developing roller 26 is placed in contact with the photosensitive drum 30 when the developer cartridge 22 is mounted in the frame 21. The developing roller 26 includes a metal roller shaft covered by a main roller body 26A formed of an electrically conductive urethane rubber or silicon rubber containing fine carbon particles or the like. The surface of the main roller body 26A is coated with a layer of urethane rubber or silicon rubber containing fluorine. A developing bias is applied to the developing roller 26 during a developing operation. The developing roller 26 is driven to rotate by a driving force transmitted from the motor (not shown).

The thickness-regulating blade 27 includes a main blade member formed of a metal leaf spring member, and a pressing part provided on a distal end of the main blade member. The pressing part is formed of an insulating silicon rubber and has a semicircular cross section. The thickness-regulating blade 27 is supported on the accommodating case 23 above the developing roller 26 so that the pressing part is pressed against the developing roller 26 by the elastic force of the main blade member.

During a developing operation, toner T discharged from the toner-accommodating chamber 24 is supplied onto the developing roller 26 by the rotation of the supply roller 25. At this time, the toner T is positively tribocharged between the supply roller 25 and developing roller 26. As the developing roller 26 continues to rotate, the toner T supplied onto the developing roller 26 passes beneath the thickness-regulating blade 27, which further tribocharges the toner T and forms a thin layer of uniform thickness on the developing roller 26.

The photosensitive drum 30 is cylindrical in shape and is configured of a metal main drum body that is grounded and has a positive charging photosensitive layer formed of polycarbonate on its outer surface. The photosensitive drum 30 is rotatably provided about a metal drum shaft 30A penetrating the axial center of the main drum body and extending in the axial direction thereof. The drum shaft 30A is supported on the frame 21. The photosensitive drum 30 is driven to rotate by a driving force transmitted from the motor (not shown).

The charger 31 is disposed diagonally above and rearward of the photosensitive drum 30. The charger 31 opposes the photosensitive drum 30, and is separated a prescribed distance therefrom. The charger 31 is a positive charging Scorotron type charger that produces a corona discharge from a charging wire formed of tungsten in order to form a uniform charge of positive polarity over the surface of the photosensitive drum 30.

The cleaning brush 33 is disposed in opposition to the rear side of the photosensitive drum 30 and in contact with the photosensitive drum 30.

In this embodiment, as the photosensitive drum 30 rotates, the charger 31 charges the surface of the photosensitive drum 30 with a uniform positive charge of +900 V. Subsequently, a laser beam emitted from the scanning unit 18 is scanned at a high speed over the surface of the photosensitive drum 30, forming an electrostatic latent image corresponding to an image to be formed on the paper 3 by selectively changing the surface potential on portions of the surface to +100 V.

Next, toner T positively charged to +450 V and carried on the surface of the developing roller 26 comes into contact with the photosensitive drum 30 as the developing roller 26 rotates. And then, the toner T is supplied to the electrostatic latent image formed on the surface of the photosensitive drum 30. In this way, the latent image on the photosensitive drum 30 is developed into a visible image according to a reverse developing process so that a toner image is carried on the surface of the photosensitive drum 30.

Subsequently, as the transfer belt 38 conveys a sheet of paper 3 through a transfer position between the photosensitive drum 30 and a transfer roller 39, the toner image carried on the surface of the photosensitive drum 30 is transferred onto the paper 3 by a negative transfer bias (−700 V) applied to the transfer roller 39. After the toner image is transferred, the paper 3 is conveyed to a fixing unit 42 described later.

The paper-conveying unit 35 will be explained as follows. The paper-conveying unit 35 is disposed below the image-forming unit 20 mounted in the accommodating section 19. The paper-conveying unit 35 includes a pair of belt support rollers 36 and 37 arranged parallel to each other and separated in the front-to-rear direction, and the transfer belt 38 looped around the belt support rollers 36 and 37. The support roller 36 disposed on the rear side is driven to rotate by the motor so that the transfer belt 38 moves circularly. The transfer belt 38 is an endless belt formed of a synthetic resin material such as polycarbonate and has a width no less than a width of the maximum paper size that can be printed on the laser printer 1. In this embodiment, an A4-size paper is set as a maximum sided paper.

Four transfer rollers 39 are disposed at regular intervals in the front-to-rear direction inside the transfer belt 38 at positions opposing the respective photosensitive drums 30 in the image-forming unit 20 described above. Accordingly, the transfer belt 38 is interposed between the photosensitive drums 30 and the corresponding transfer rollers 39.

A belt-cleaning unit 41 is disposed below the transfer belt 38. The belt-cleaning unit 41 has a cleaning roller 40 for cleaning residual toner T deposited on the transfer belt 38. When conveyed by the registration rollers 12A and 12B, the paper 3 passes through the paper-conveying path 14 and contacts the front end of the top surface of the transfer belt 38. The paper 3 is electrostatically attracted to the top surface of the transfer belt 38 and is conveyed rearward as the transfer belt 38 moves circularly.

The fixing unit 42 will be explained as follows. The fixing unit 42 is provided in the main casing 2 rearward of the paper-conveying unit 35. The fixing unit 42 includes a heating roller 43 and a pressure roller 44 disposed in confrontation with each other for fixing a toner image on the paper 3 with heat. Conveying rollers 45 disposed diagonally above and rearward of the fixing unit 42 receive the paper 3 after the toner image has been fixed thereon. The conveying rollers 45 convey the paper 3 to a pair of discharge rollers 46 disposed near the top of the main casing 2. A discharge tray 47 which is substantially level on the front side and slopes downward toward the rear side is formed on the top surface of the main casing 2. After the conveying rollers 45 convey the paper 3 to the discharge rollers 46, the discharge rollers 46 discharge the paper 3 onto the discharge tray 47.

The next description will be made for explaining detailed structure of the belt-cleaning unit 41. The belt-cleaning unit 41 includes an elongated box-shaped case 50 extending in the front-to-rear direction that is provided below the transfer belt 38. The case 50 has an opening 51 formed in the top surface near the front side thereof. The cleaning roller 40 is rotatably provided inside the case 50 with a top portion being exposed through the opening 51. The cleaning roller 40 is a silicon foam roller configured of a metal roller shaft 40A that is covered with a roller member formed of an electrically conductive foam material.

A metal roller 52 is formed of a metal or any hard material and rotatably provided diagonally below and forward of the cleaning roller 40. The metal roller 52 contacts the cleaning roller 40 with pressure.

A scraping blade 53 is disposed below the metal roller 52. The scraping blade 53 includes an elastic main blade member and has a fixed front end and a free rear end that contacts the lower surface of the metal roller 52 with pressure through the elastic force of the main blade member. A backup roller 54 is provided in order to contact the inner surface of the transfer belt 38. The backup roller 54 is formed of a metal or any conductive material and rotatably provided above the cleaning roller 40 so that the transfer belt 38 is pinched between the backup roller 54 and the cleaning roller 40 from above and below, respectively.

Figure 2:
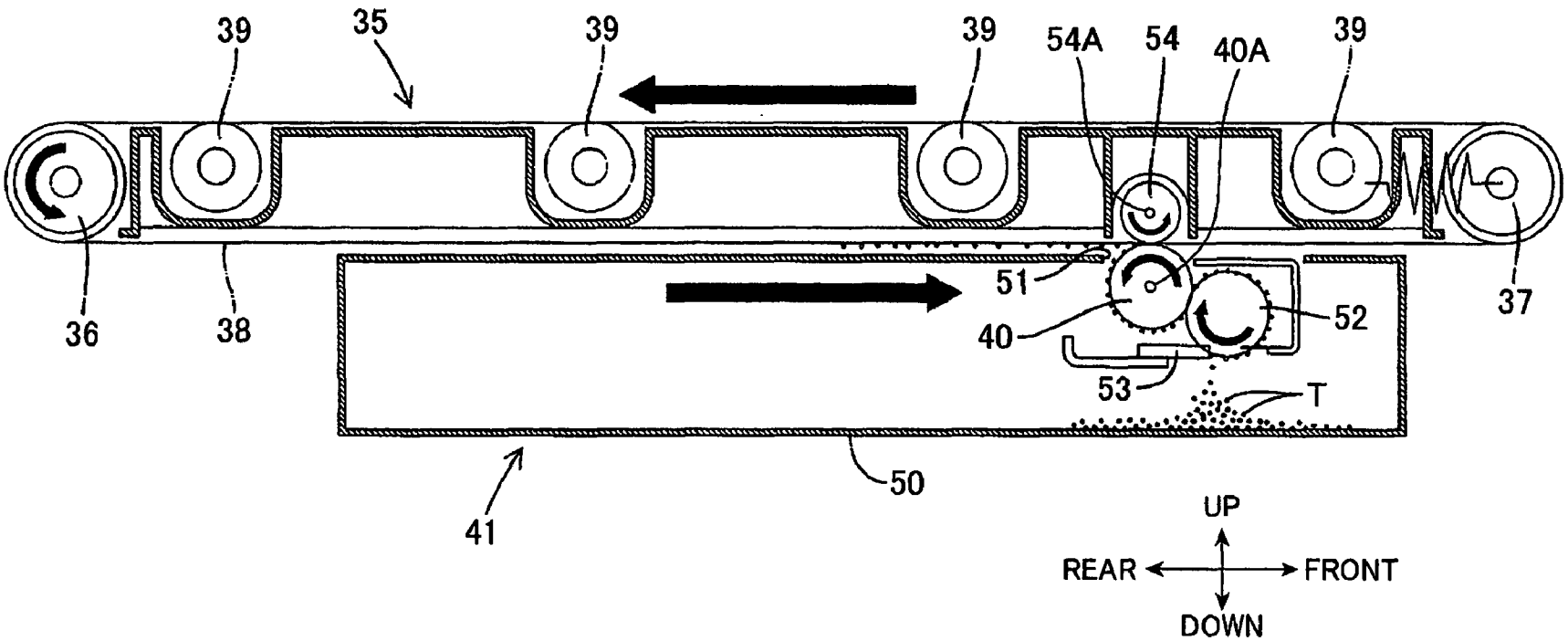
FIG. 2 is an enlarged side cross-sectional view of a paper-conveying unit and a belt-cleaning unit.

During a cleaning operation, the motor (not shown) provides a driving force for driving the cleaning roller 40 to rotate counterclockwise and for driving the metal roller 52 to rotate clockwise, as indicated in FIG. 2, while the transfer belt 38 simultaneously moves circularly in the counterclockwise direction of FIG. 2. Thus, the cleaning roller 40 rotates with the outer peripheral surface thereof contacting the outer surface of the transfer belt 38. The backup roller 54 rotates counterclockwise in FIG. 2 along with the circular movement of the transfer belt 38.

Further, the roller shaft 54A of the backup roller 54 is grounded. In this embodiment, during a cleaning operation, a negative bias of −1200 V is applied to the cleaning roller 40. And an even lower negative bias of −1600 V is applied to the metal roller 52. Accordingly, residual toner T and paper dust deposited on the transfer belt 38 migrate to the cleaning roller 40 near the position at which the cleaning roller 40 faces the backup roller 54 by the shortest distance due to the bias attraction and the contact force of the cleaning roller 40. The residual toner T carried on the cleaning roller 40 is subsequently transferred to the hard metal roller 52 by the bias attraction, scraped off of the metal roller 52 by the scraping blade 53, and collected ultimately in the case 50.

Figure 3:
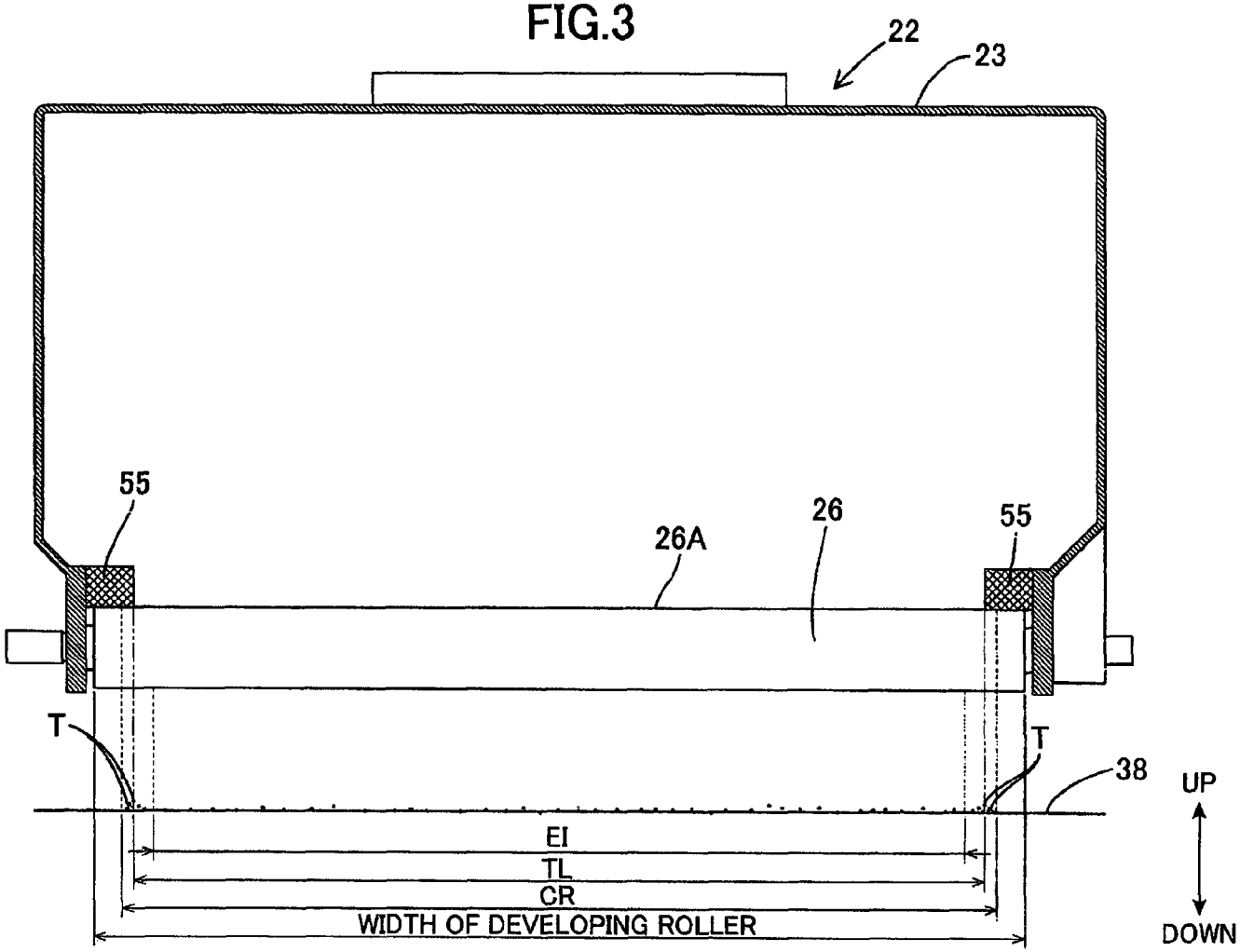
FIG. 3 is an explanatory diagram showing the relationship between sealing members and a thin layer forming region.

The next description will be made for explaining sealing members and a thin layer forming region. Referring to FIG. 3, a pair of sealing members 55 are formed of felt and provided on both ends of the developing roller 26, and slidingly contact the surface of the main roller body 26A on the developing roller 26 from above. The sealing members 55 function to prevent toner T supplied from the supply roller 25 from leaking off of the developing roller 26 in the widthwise direction thereof. With this construction, the outer surface of the developing roller 26 between the sealing members 55 is narrower than the original width of the developing roller 26, and constitutes a thin layer forming region TL. The thin layer forming region TL is provided on the developing roller 26 and a region on which a thin uniform layer of the toner T is formed and carried between the sealing members 55 when toner T is supplied to the developing roller 26. An effective image forming region EI on the photosensitive drum 30 falls within the thin layer forming region TL. The effective image forming region EI is defined as the region of the photosensitive drum 30 in which at least a prescribed level of image quality is guaranteed for forming an image on a paper 3. Hence, electrostatic latent images are formed through exposure by the scanning unit 18 in this effective image forming region EI.

Figure 4:
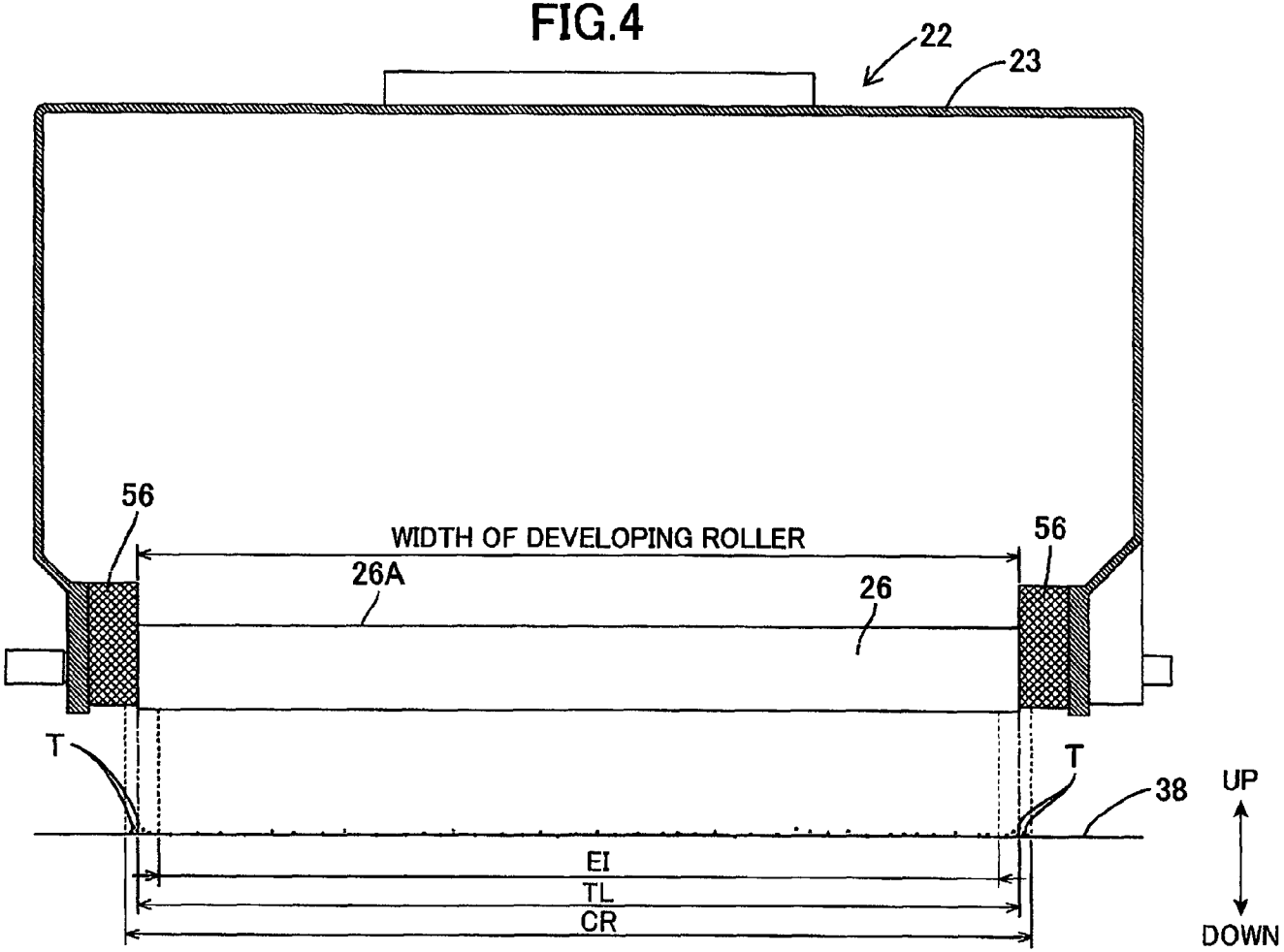
FIG. 4 is an explanatory diagram showing the relationship between sealing members and a thin layer forming region.

FIG. 4 shows a modification of the sealing members. Referring to FIG. 4, sealing members 56 are formed of felt, and provided on both ends of the developing roller 26 so as to contact the end faces of the main roller body 26A. Similarly, the sealing members 56 function to prevent toner T supplied from the supply roller 25 from leaking off the developing roller 26 in the widthwise direction thereof. In this embodiment, the thin layer forming region TL has the same width as the entire width of the main roller body 26A on the developing roller 26 located between the sealing members 56. The effective image forming region is formed narrower than the width of the thin layer forming region TL so as to fall within the thin layer forming region TL.

In both structures shown in FIGS. 3 and 4, the widthwise ends of the main roller body 26A may be worn by the sealing members 55, 56 and/or the toner T entered between the sealing members 55, 56 and the main roller body 26A. The worn widthwise ends of the main roller body 26A may cause the toner T to leak toward any area other than the thin layer forming region TL therethrough. Consequently, the toner T leaked from the worn ends of the developing roller 26 may reach the outer surface of the transfer belt 38 beyond the effective image forming region EI and even beyond the thin layer forming region TL. A cleaning region CR to be cleaned on the transfer belt 38 (described below) must be defined with consideration for the above problem. Since the toner T used in this embodiment is a polymerized toner that is spherical in shape and less grainy than ground toner, the toner T has a tendency to easily enter between the developing roller 26 and the sealing members 55 and 56, compared with the ground toner. Moreover, since the laser printer 1 employs a contact developing method in which the photosensitive drum 30 contacts the developing roller 26, leaked toner T is more likely to migrate onto the photosensitive drum 30 and become deposited on the transfer belt 38.

Figure 5:
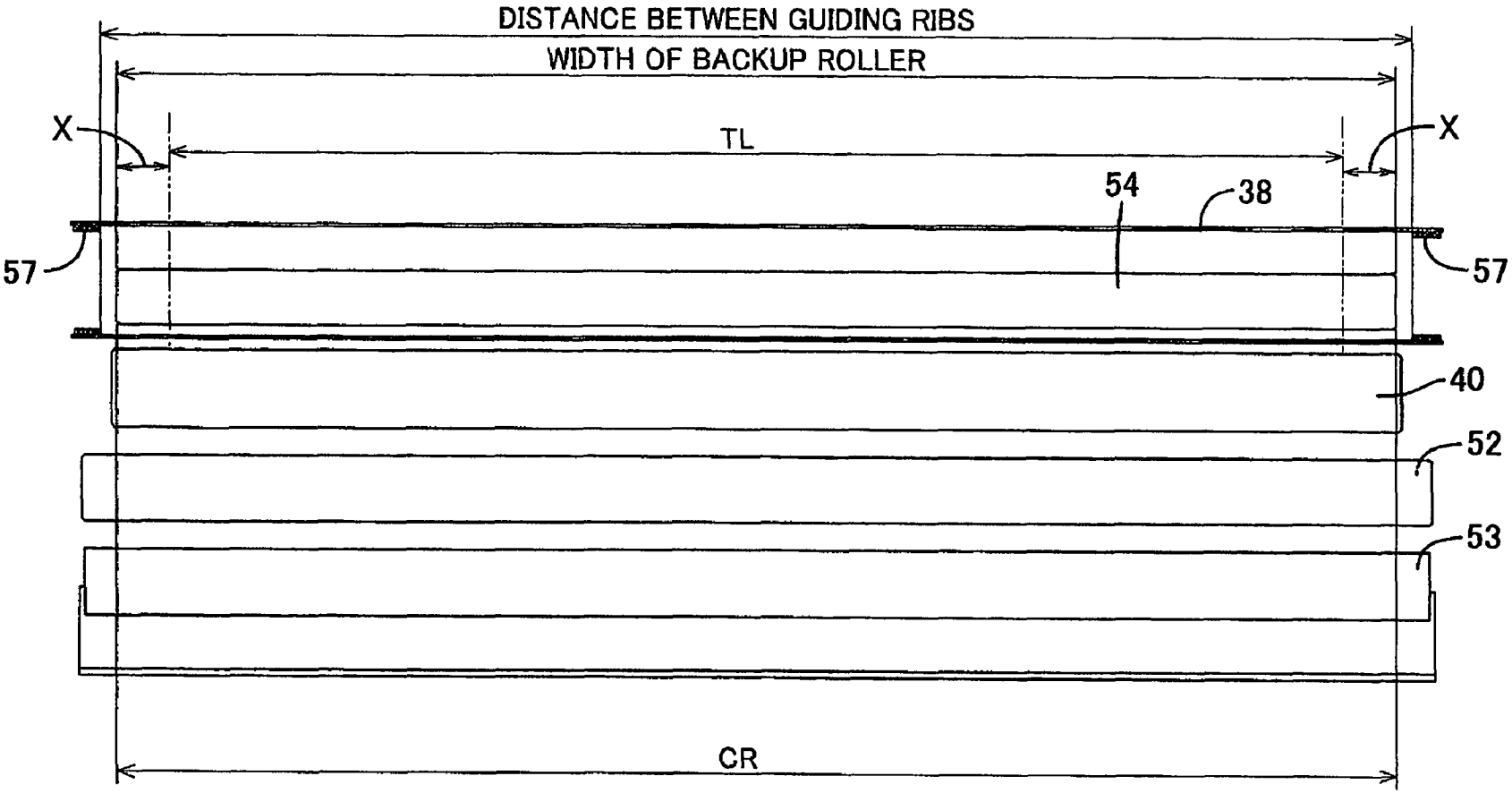
FIG. 5 is an explanatory diagram illustrating relationships between widths of various components and the transfer belt.

The cleaning region CR will be described as follows. Referring to FIG. 5, a pair of guiding ribs 57 are provided on both edges of the transfer belt 38 along the entire inner peripheral surface thereof. The guiding ribs 57 are positioned outside of the outer peripheral surfaces of the belt support rollers 36 and 37 when the transfer belt 38 is looped over the belt support rollers 36, 37. The guiding ribs 57 function to prevent skewing of the transfer belt 38. In this embodiment, the width (length in the axial direction) of the backup roller 54 is designed to be shorter than the distance between the pair of guiding ribs 57. The backup roller 54 is 10 mm longer than the width of the thin layer forming region. Hence, the both edges of the backup roller 54 each extend 5 mm beyond the thin layer forming region, which is indicated by an extended length X in FIG. 5, while remaining between the guiding ribs 57.

The length of the cleaning roller 40 in the axial direction is designed to be sufficiently long to the extent that both ends thereof extend slightly beyond the backup roller 54. The metal roller 52 and scraping blade 53 are designed to have a width to the extent that both ends thereof extend by the same length beyond the cleaning roller 40.

With this construction, the "cleaning region CR" in which the belt-cleaning unit 41 cleans the transfer belt 38 is determined by the width of the backup roller 54, which has the shortest width among the backup roller 54, the cleaning roller 40, the metal roller 52, and the scraping blade 53.

The backup roller 54 is designed with a length sufficient to extend about 5 mm beyond the thin layer forming region at both ends, as described above. This length of 5 mm was determined so that the belt-cleaning unit 41 can reliably clean toner leaking from the ends of the developing roller 26 onto the surface of the transfer belt 38. The range in which toner leaks outward in the width direction was found through experiment.

Figure 6:
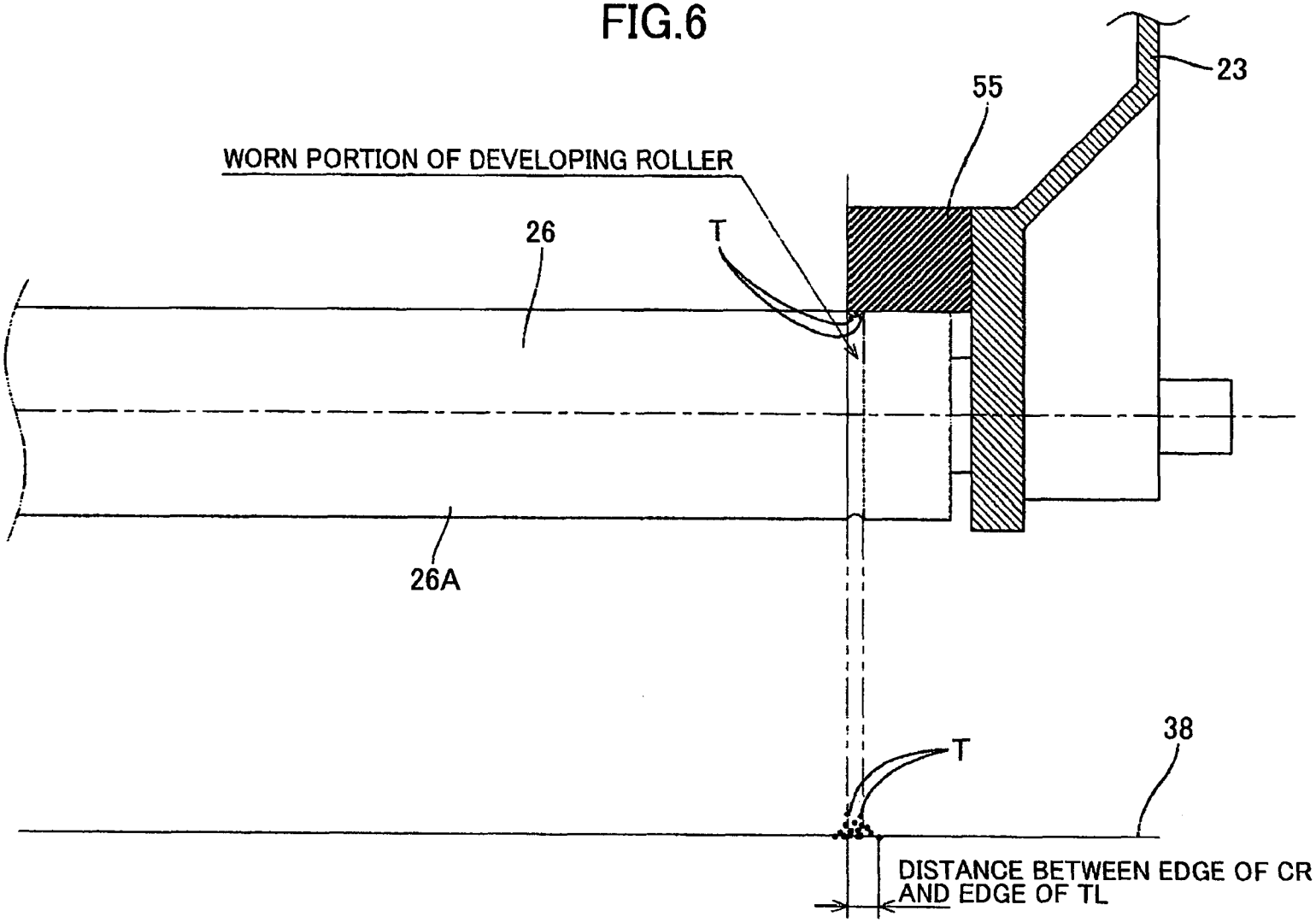
FIG. 6 is an explanatory diagram illustrating the leakage of toner occurring at a boundary between the sealing member and a developing roller.

Referring to FIG. 6, toner attached to the sealing members 55 (or sealing members 56) wears down the surface of the developing roller 26, forming a groove about 1 mm wide at the border of the sealing members 55 (or sealing members 56) through which toner may be leaked. Since the maximum width of leaked toner T on the transfer belt 38 outside the thin layer forming region is about 2 mm, it is necessary to extend the cleaning region CR at least 2 mm past the thin layer forming region in order to remove the leaked toner. In other words, the cleaning region CR is established with respect to the thin layer forming region TL so that the widthwise ends of the cleaning region CR are positioned outside of the thin layer forming region TL by at least 2 mm from the thin layer forming region TL in the widthwise direction.

However, since any excessive cleaning region CR which is more than the required is not conducive to producing a compact laser printer, the extended length in this embodiment is set to 5 mm in consideration for a tolerance in manufacturing the components, and scattering of the deposited toner.

In the first embodiment, the cleaning region CR of the transfer belt 38 by the belt-cleaning unit 41 is designed to have a greater width than that of the thin layer forming region, which is greater than the width of the effective image forming region. Accordingly, the belt-cleaning unit 41 can reliably clean toner T deposited on the transfer belt 38 outside of the region corresponding to the thin layer forming region. In other words, the cleaning region CR to be cleaned by the belt-cleaning unit 41 is designed to be greater than the area corresponding to the thin layer forming region by a length sufficient for reliably cleaning toner T leaked from the worn ends of the developing roller 26 and deposited on the transfer belt.

The cleaning roller 40 is driven to rotate in a direction opposite to the direction that the transfer belt 38 moves at the contact position with the transfer belt 38. That is, the peripheral surface of the cleaning roller 40 moves against the moving direction of the transfer belt 38. This produces a peripheral velocity differential between the cleaning roller 40 and transfer belt 38 at the contact position, improving and enhancing the cleaning ability of the cleaning roller 40.

Alternatively, the structure for producing "a peripheral velocity differential between the cleaning roller 40 and the transfer belt 38 may be any configuration that drives the cleaning roller 40 to rotate at a different velocity from the velocity of the transfer belt 38. For example, the cleaning roller 40 may be driven to rotate in a direction against, or opposite to, the moving direction of the transfer belt 38, or in the same direction of the transfer belt 38 at different velocities.

The backup roller 54 is disposed at a position inside the guiding ribs 57, which are provided on the inner surface of the transfer belt 38. With this construction, the backup roller 54 contacts the inner surface of the transfer belt 38 with pressure across the entire longitudinal length of the backup roller 54. Therefore, the transfer belt 38 is reliably pinched between the backup roller 54 and the cleaning roller 40 uniformly so that cleaning can be performed uniformly across the width.

Further, the cleaning roller 40 has a narrower width than the transfer belt 38 and is disposed such that the widthwise edges thereof are positioned inside the edges of the transfer belt 38. This construction prevents the both edges of the transfer belt 38 from contacting the outer peripheral surface of the cleaning roller 40 and degrading the cleaning capacity of the cleaning roller 40.

Figure 7:
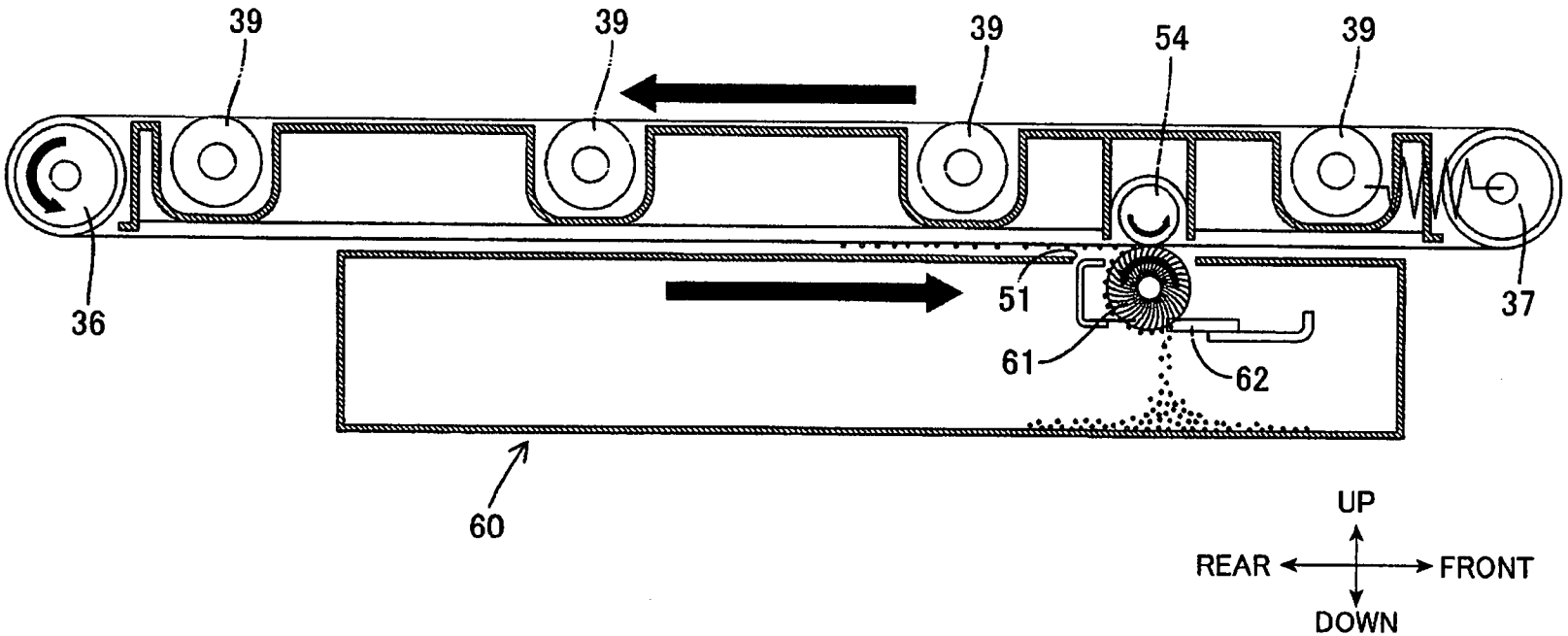
FIG. 7 is an enlarged side cross-sectional view showing a paper-conveying unit and a belt-cleaning unit according to the present invention.

A second embodiment of the present invention will be described referring to FIG. 7. In FIG. 7, like parts and components are designated with the same reference numerals to avoid duplicating description. The second embodiment differs from the first embodiment only in the structure of the belt-cleaning unit.

As shown in FIG. 7, a belt-cleaning unit 60 is provided in place of the belt-cleaning unit 41 of the first embodiment and includes a brush roller 61 in place of the cleaning roller 40. Further, this construction does not include the metal roller 52, but does include a scraping blade 62 having a fixed front end, and a free rear end that contact a brush portion of the brush roller 61 with pressure. More specifically, the rear end of the scraping blade 62 protrudes to the brush roller 61 in a direction opposing the rotating direction of the brush roller 61.

With this construction, the width of the cleaning region CR is determined by the narrowest width among the backup roller 54, the brush roller 61, and the scraping blade 53. However, the cleaning region CR has a width sufficient to protrude the widthwise end thereof outside of the region projected by the thin layer forming region TL by at least 2 mm. In another embodiment, the cleaning region CR may have widthwise ends to protrude outside of the projected region of the thin layer forming region by 5 mm.

While the invention has been described in detail with reference to specific embodiments thereof, it would be apparent to those skilled in the art that many modifications and variations may be made therein without departing from the spirit of the invention, the scope of which is defined by the attached claims.

While two rotating members are provided in the cleaning unit of the first embodiment and a single rotating member in the second embodiment, it is within the scope of the present invention that the cleaning unit has three or more rotating members.

Figure 8:
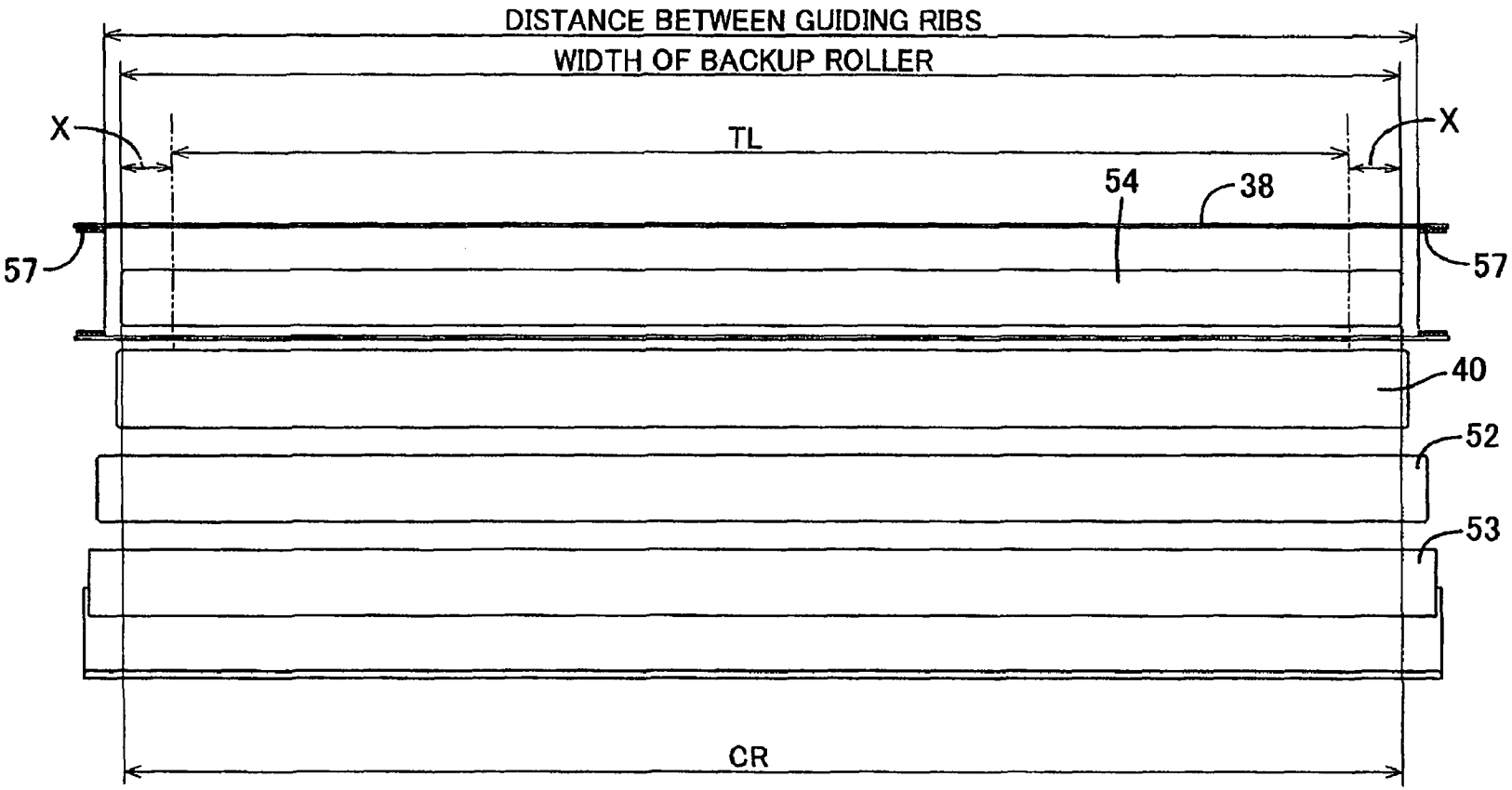
FIGS. 8 through 11 are explanatory diagrams illustrating relationships between widths of various components and the transfer belt.

FIGS. 8 through 11 show modifications of the cleaning unit in the first embodiment. In FIG. 8, the metal roller 52 is longer than the cleaning roller 40 and shorter than the scraping blade 53. In this embodiment, the backup roller 54 has the shortest width to define the width of the cleaning region CR.

Figure 9:
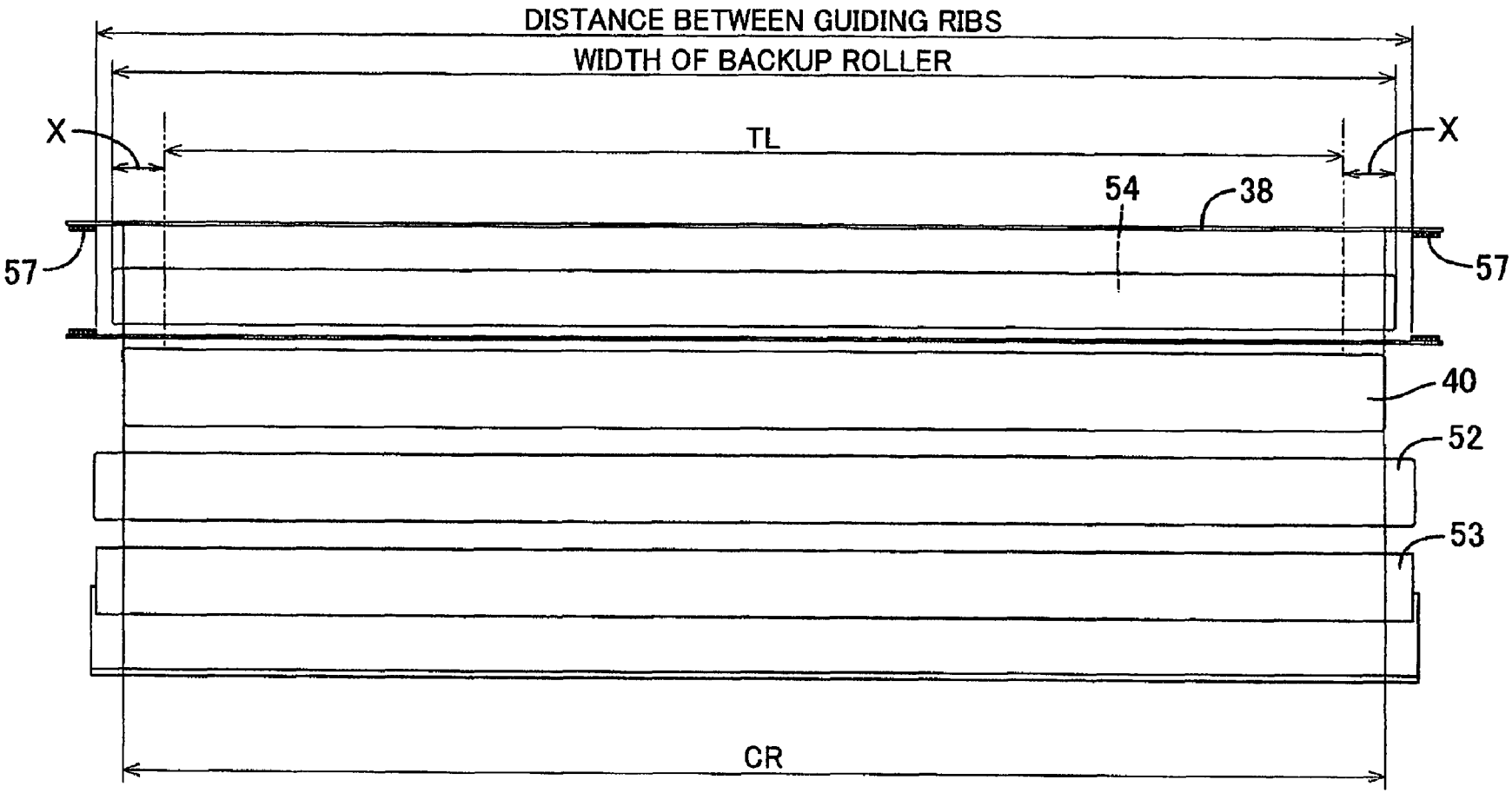

Referring to FIG. 9, the cleaning roller 40 is configured shorter than the backup roller 54. Hence, the width of the cleaning region CR is determined by the width of the cleaning roller 40.

Figure 10:
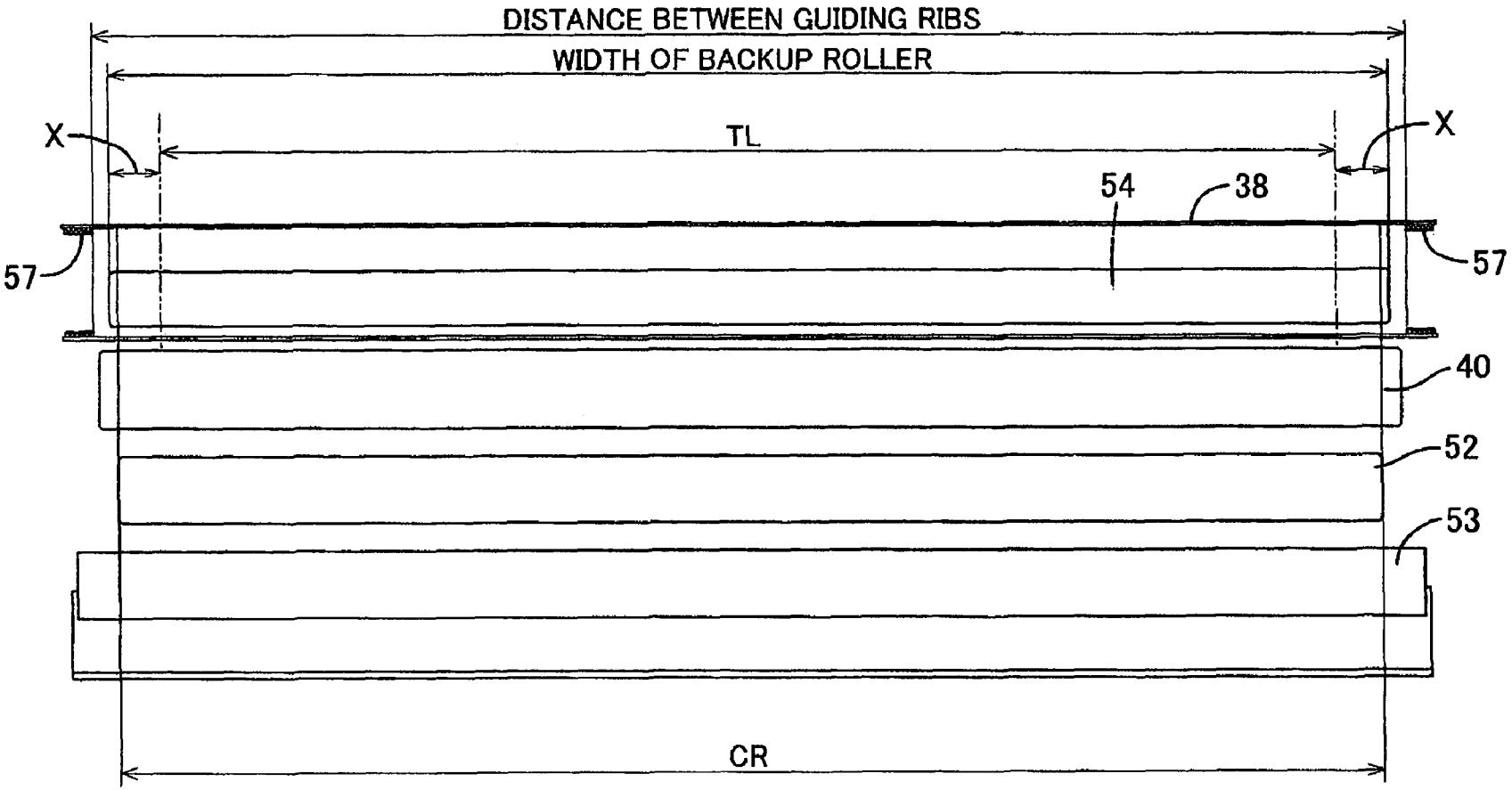

Referring to FIG. 10, the metal roller 52 is configured shorter than the backup roller 54. Hence, the width of the cleaning region CR is governed by the width of the metal roller 52.

Figure 11:
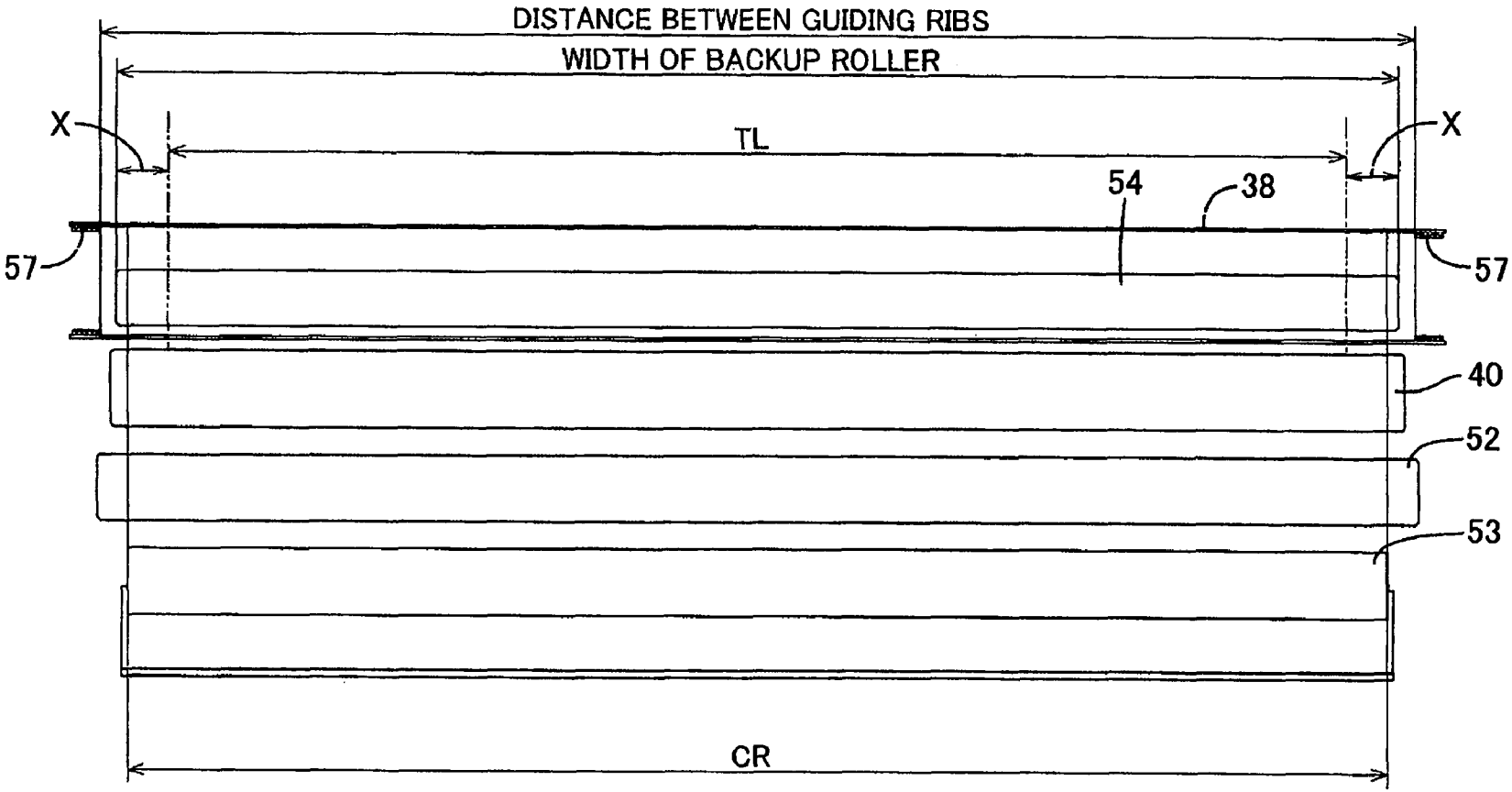

Referring to FIG. 11, the scraping blade 53 is configured shorter than the backup roller 54. Hence, the width of the cleaning region CR is determined by the width of the scraping blade 53.

Figure 12:
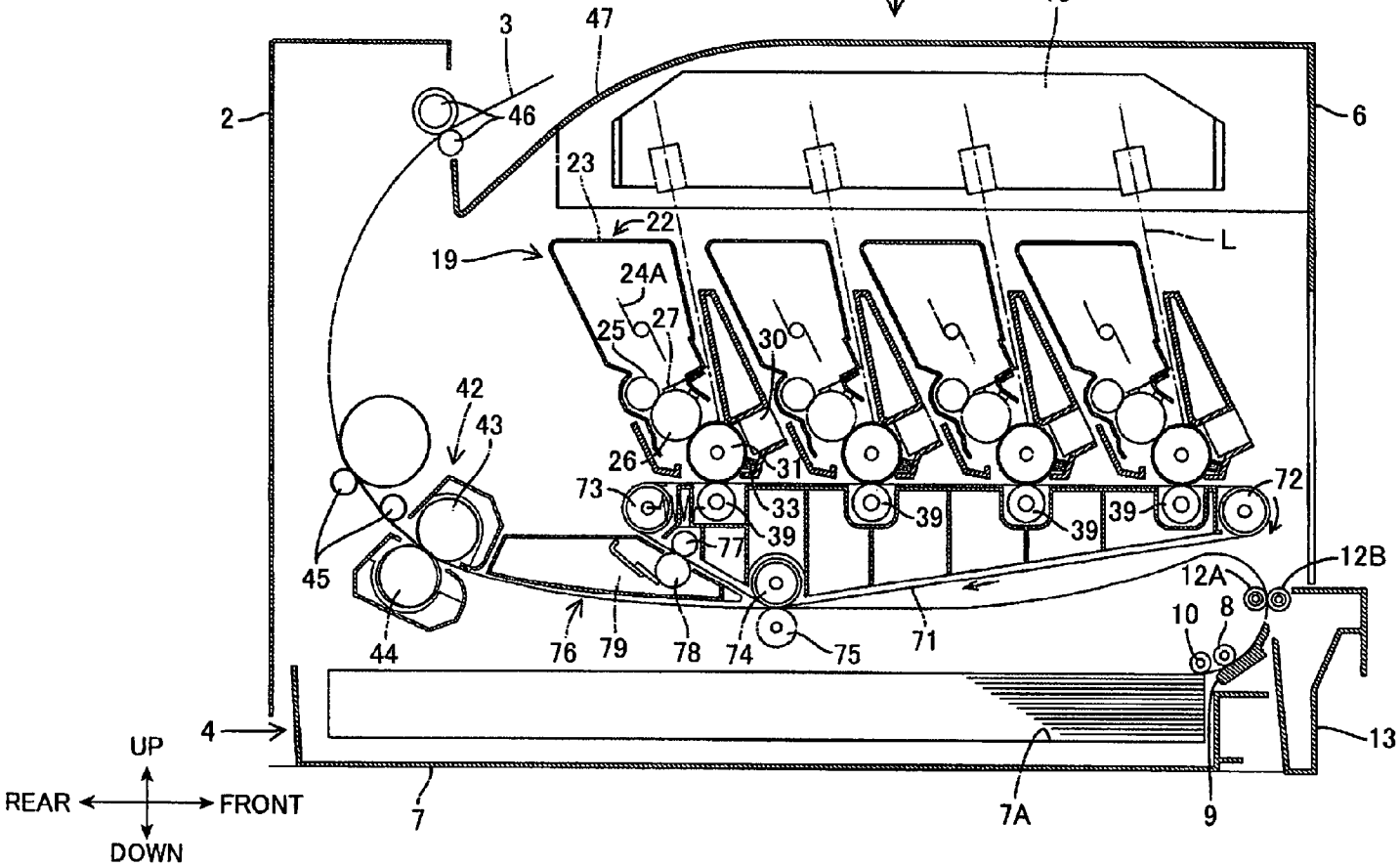
FIG. 12 is a side cross-sectional view of an intermediate tandem type color laser printer according to the present invention.

While the present invention is applied to a direct tandem type color laser printer in the above embodiments, the invention may also be applied to an intermediate tandem type color laser printer, such as that shown in FIG. 12. In FIG. 12, like parts and components are designated with the same reference numerals to avoid duplicating description.

Referring to FIG. 12, a laser printer 70 is an intermediate tandem type color laser printer and provided with an intermediate transfer belt 71 in place of the transfer belt 38. The intermediate transfer belt 71 is looped around three belt support rollers 72, 73, and 74 and moves circularly clockwise in FIG. 12 when the support roller 72 is driven to rotate. As the intermediate transfer belt 71 moves in one rotation, toner of each color is sequentially transferred thereon and superposed on each other, forming a four-color toner image. The four-color toner image is subsequently transferred at once onto the paper 3 at a transfer position between the support roller 74 and a transfer roller 75 disposed below and in opposition to the support roller 74.

The laser printer 70 also includes a belt-cleaning unit 76 provided at a position for cleaning the intermediate transfer belt 71 between the belt support rollers 73 and 74 downstream of the transfer position between the support roller 74 and transfer roller 75. As in the second embodiment, the belt-cleaning unit 76 includes a backup roller 77, a cleaning roller 78, and a scraping blade 79. However, the belt-cleaning unit 76 may be configured as in the first embodiment with a backup roller, a cleaning roller, a metal roller, and a scraping blade. Here, the cleaning region CR is determined by the member having the narrowest left-to-right width among these components. As to modifications of the cleaning units, the laser printer 70 can adopt any one of structures shown in FIGS. 5, 8, 9, 10, and 11.

In the description, the "recording medium" refers to a sheet of paper or other recording medium formed of a paper material and a plastic recording medium such as a transparency sheet. Further, the "belt" refers to an intermediate transfer belt and a conveying belt for conveying a recording medium. Further, the "image-forming device" refers to a printing device, such as a laser printer; a facsimile device; and a multifunction device having various functions such as a printer function and a scanner function. When employing the belt described above, the image-forming device refers to a tandem (single pass) device having an image-carrying member for each developer unit, and a four-cycle (single drum) device in which each developer unit develops images on a common image-carrying member. The image-forming device may be a direct transfer type device for transferring developer images onto the recording medium directly. Alternatively the image forming device may be an intermediate transfer type device for indirectly transferring the developer images via an intermediate transfer belt.

The "rotating body" refers to a roller body formed of a foam material, or a roller body having a brush disposed on the peripheral surface thereof.

With this construction, the cleaning region of the cleaning unit is set sufficiently wide to extend beyond the thin layer forming region of the developer-carrying member on both ends thereof. Hence, the cleaning means can clean developer deposited on the belt beyond the width of the thin layer forming region, which is wider than the effective image forming region.

When sealing members are provided on both ends of the developer-carrying member for preventing developer from leaking from the widthwise ends of the developer-carrying member, the sealing members and/or developer attached the sealing members may grind the surface of the developer-carrying member at the ends thereof, allowing developer to leak from the ends and become deposited on the outer surface of the belt. Therefore, the image-forming device of the present invention provides a cleaning region that is wider than the thin layer forming region provided between the sealing members in order to reliably clean the belt. The cleaning region is wider than the thin layer forming region by at least 2 mm at one end. Alternatively, the cleaning region is wider than the thin layer forming region by 5 mm at one end.

In the construction described above, the width dimension of the cleaning region in the belt width direction is governed by the width of the narrowest member among the rotating body (or plurality of rotating bodies), the scraping member, and the backup member.

The construction described above improves the capacity for cleaning the belt by driving the rotating body to rotate so as to generate a peripheral velocity differential with the belt at the surface of contact.

In order to prevent skew in the belt, the guiding ribs are disposed along the inner surface of the belt between the tension rollers. With this construction, the backup member has a narrower width than the distance between the pair of guiding ribs and is disposed between the pair of guiding ribs so as to press firmly against the inner surface of the belt.

Since polymerized toner is spherical in shape and not as grainy as ground toner, the polymerized toner has low scatter and excellent reproducibility with electrostatic latent images. On the other hand, polymerized toner is more difficult to clean and can more easily work into the sealing members and grind the developer-carrying member. Accordingly, it is desirable to be able to clean this polymerized toner thoroughly by the cleaning unit described above.

Developing methods include a jumping method in which the developer-carrying member is separated from the image-carrying member, and the developer carried on the developer-carrying member jumps onto the image-carrying member by electrostatic attraction; and a contact method in which the developer-carrying member is placed in contact with the image-carrying member to develop the latent image. Of these types, the contact developing method is more susceptible to leaked developer transferring from the developer-carrying member to the image-carrying member. Therefore, the cleaning unit described above is applicable to the above developing methods.

When the rotating member is wider than the belt width, it is likely that the edges of the belt will wear the peripheral surface of the sponge rotating body, leading to a decline in cleaning quality. Therefore, the width of the rotating member with a surface made of a foam material is set narrower than the belt width so that the edges of the belt do not contact the peripheral surface of the sponge rotating body, thereby preventing the rotating member from being worn.

What is claimed is:

1. An image-forming device comprising:

a developer-carrying member having an outer surface including a layer forming region for carrying a layer of developer, the layer forming region having a first width in a widthwise direction, the layer forming region including an effective image forming region used for forming an image on a recording medium, the effective image forming region having a width which is shorter than the first width;

an image-carrying member having a surface on which an electrostatic latent image based on the image is formed and developed into a developer image by the developer carried on the effective image forming region;

a belt configured to circulate in a moving direction orthogonal to the widthwise direction and transfer the developer image onto the recording medium; and a cleaning unit that cleans the developer on a cleanable region on an outer surface of the belt, the cleanable region having a second width in the widthwise direction of the belt, wherein the second width is greater than the first width, the cleanable region being placed with respect to the layer forming region so that each widthwise end of the cleanable region is positioned outside of each widthwise end of the layer forming region in the widthwise direction, wherein the belt has an inner surface opposing the outer surface, and wherein the cleaning unit comprises:

a cleaning member that receives the developer from the outer surface of the belt, the cleaning member having a third width in the widthwise direction;

a removing member that removes the developer from the cleaning member, the removing member having a fourth width in the widthwise direction; and a backup member that contacts the inner surface of the belt and opposes the cleaning member with the belt being intervened therebetween, the backup member having a fifth width in the widthwise direction, and wherein the cleaning member comprises a first rotating element and a second rotating element, the first rotating element receiving the developer from the outer surface of the belt and having a sixth width in the widthwise direction, the second rotating element transferring the developer from the first rotating element and having a seventh width in the widthwise direction, and wherein the fifth width is greater than the first width, the sixth width is greater than the fifth width, and the seventh width is greater than the sixth width.

2. The image-forming device according to claim 1, further comprising a pair of sealing members provided at each widthwise end of the developer-carrying member to contact the developer-carrying member, the outer surface of the developer-carrying member between the sealing members being defined as the layer forming region, wherein a distance between each widthwise end of the cleanable region and the corresponding widthwise end of the layer forming region is more than or equal to 2 mm.

3. The image-forming device according to claim 1, wherein the second width is equal to a shortest one among the third width, the fourth width, and the fifth width.

4. The image-forming device according to claim 3, wherein the removing member removes the developer from the second rotating element, and wherein the second width is equal to a shortest one among the fourth width, the fifth width, the sixth width, and the seventh width.

5. The image-forming device according to claim 3, wherein the belt is configured to circulate at a first velocity, and the first rotating element is disposed in contact with the outer surface of the belt, the first rotating element is driven to rotate at a second velocity which is different from the first velocity.

6. The image-forming device according to claim 3, further comprising tension rollers that drive and stretch the belt, each tension roller having an eighth width in the widthwise direction, wherein:

the belt has two ends in the widthwise direction and a guiding rib provided at each end, the two guiding ribs being separated by a predetermined distance, each guiding rib being positioned outside of the tension roller in the widthwise direction; and the fifth width is shorter than the predetermined distance, the backup member is positioned between the guiding ribs.

7. The image-forming device according to claim 3, wherein:

the belt has a sixth width in the widthwise direction; the cleaning member contacts the outer surface of the belt, the sixth width is greater than the third width; and the cleaning member is positioned with respect to the belt so that each widthwise end of the cleaning member is positioned inside of a corresponding widthwise end of the belt.

8. The image-forming device according to claim 1, further comprising an auxiliary member opposing the image-carrying member through the belt, wherein:

the belt conveys the recording medium to the image-carrying member; and the auxiliary member is configured to transfer the developer image onto the recording medium in cooperation with the belt.

9. The image-forming device according to claim 1, wherein the layer forming region has a substantially uniform thickness of developer in the widthwise direction.

10. The image-forming device according to claim 1, wherein the developer is a polymerized toner.

11. The image-forming device according to claim 1, wherein the developer-carrying member contacts the image-carrying member to develop the electrostatic latent image.

12. The image forming device according to claim 1, wherein the fourth width is greater than the first width.

13. The image forming device according to claim 1, wherein:

the first rotating element is formed of a foam material;

the second rotating element is formed of a metal; and the removing member is an elastic blade.

14. An image-forming device comprising:

an image-carrying member that carries a developer image made from developer;

a belt having an outer surface, an inner surface opposing the outer surface, and a first width in a widthwise direction, the belt being configured to circulate in a direction orthogonal to the widthwise direction and transfer the developer image onto a recording medium; and a cleaning unit that cleans the developer on the outer surface, the cleaning unit having a cleaning member that receives the developer from the outer surface of the belt, the cleaning member contacting the outer surface, the cleaning member having a second width in the widthwise direction, the second width being shorter than the first width, the cleaning member being placed with respect to the belt so that each widthwise end of the cleaning member is positioned inside of a corresponding widthwise end of the belt in the widthwise direction, wherein the cleaning unit comprises:

the cleaning member;

a removing member that removes the developer from the cleaning member, the removing member having a fourth width in the widthwise direction; and a backup member that contacts the inner surface of the belt and opposes the cleaning member with the belt being intervened therebetween, the backup member having a fifth width in the widthwise direction; and wherein the cleaning member comprises a first rotating element made from a foam material and a second rotating element, the first rotating element receiving the developer from the outer surface of the belt, the first rotating element having a sixth width in the widthwise direction, the second rotating element transferring the developer from the first rotating element, the second rotating element having a seventh width in the widthwise direction, and wherein the sixth width is greater than the fifth width, the seventh width is greater than the sixth width, and the first width is greater than the seventh width.

15. The image-forming device according to claim 14, further comprising tension rollers that drive and stretch the belt, wherein:

the belt has widthwise ends in the widthwise direction and a guiding rib provided at each widthwise end of the belt, the guiding ribs being separated by a predetermined distance, each guiding rib being positioned outside of the tension rollers in the widthwise direction;

the fifth width is shorter than the predetermined distance; and the backup member is positioned between the guiding ribs.

* * * * *